United States Patent [19]

Jones

[11] 4,102,002

[45] Jul. 25, 1978

[54] SELF-WRINGING MAP

[75] Inventor: Germaine T. Jones, Los Angeles, Calif.

[73] Assignee: The Raymond Lee Organization, Inc., New York, N.Y. ; a part interest

[21] Appl. No.: 789,145

[22] Filed: Apr. 20, 1977

[51] Int. Cl.[2] ..... A47L 13/14; A47L 13/257

[52] U.S. Cl. ..... 15/119 A; 15/244 R

[58] Field of Search ..... 15/116 A, 119 A, 244 R

[56] References Cited

U.S. PATENT DOCUMENTS

| | | | |
|---|---|---|---|
| 2,163,638 | 6/1939 | Vaughn | 15/119 A X |
| 2,813,287 | 11/1957 | Vaughn | 15/119 A |
| 3,495,289 | 2/1970 | Heid | 15/119 A |

FOREIGN PATENT DOCUMENTS

| | | | |
|---|---|---|---|
| 739,099 | 6/1933 | France | 15/119 A |
| 135,601 | 5/1952 | Sweden | 15/119 A |
| 411,314 | 6/1934 | United Kingdom | 15/119 A |

*Primary Examiner*—Daniel Blum

*Attorney, Agent, or Firm*—Daniel Jay Tick

[57] ABSTRACT

A sponge has rectangular faces and a trapezoidal cross-section to enable the sponge to reach into corners and the like. The sponge is detachably secured below a plate which is itself attached to the lower end of an elongated handle. An elongated wringer plate having a center grill can be swung below the sponge and lifted up against the sponge by a lever attached to the handle, to wring the sponge out against the plate.

2 Claims, 5 Drawing Figures

SELF-WRINGING MAP

SUMMARY OF THE INVENTION

The present invention relates to a mop.

The object of the invention is to provide a sponge mop which can reach into corners with greater ease than conventional mops, and which can be more easily and effectively wrung out than conventional mops.

To this end, one of the faces of an otherwise completely rectangular sponge slopes upwardly and rearwardly, to form an elongated sponge with a trapezoidal cross-section. The sloping edge extends slightly forwardly of the body of the mop, to make tilting and pressing of the mop unnecessary when the mop is to be used to clean out a corner.

Furthermore, a novel wringing apparatus is utilized. In this apparatus, an elongated grill with an open center can be swung underneath the sponge and pulled upwardly against the sponge by a lever attached to the handle.

DETAILED DESCRIPTION OF PREFERRED EMBODIMENTS

Figure 1:
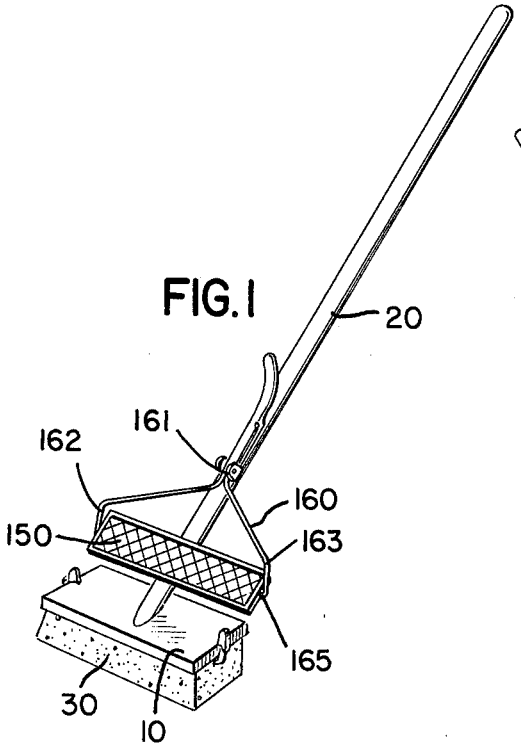
FIG. 1 is a perspective view of the mop of the invention.

A flat, rectangular and horizontal first plate 10 is attached at its center to the lower end of an elongated, upwardly and rearwardly extending handle 20.

A sponge 30 which is to be used to mop floors, is almost completely rectangular. The one face 40 which is not perpendicular to all the faces which border it slopes upwardly and rearwardly from the bottom front edge of the sponge. Since the sponge is elongated to the same top proportions as the proportions of the plate, an elongated sponge with a trapezoidal cross-section is formed, with the bases of the trapezoid being the top and bottom surfaces of the sponge.

A rectangular second plate 50 is attached to the top of the sponge, and located directly below plate 10. Plate 50 has the proportions of plate 10, and at its ends has lips 60 extending downwardly from the plate at right angles. In order to detachably secure plate 50 below plate 10, locking means are located at the ends of plate 10. Each of the locking means has a hook 70 shaped to fit over a corresponding lip, and a loop 80 at the top of each hook. The loop 80 pivotally engages a cylindrical bar 90 that extends perpendicularly between two flat elongated plates 100 intermediate their rounded ends. The top ends of the plates 100 are attached to each other by bar 110, and the bottom ends ride on axle 120 which extends through aligned holes in plates 100 and which is embedded in plate 10. It can thus be seen that the action of the plates 100 with the hook is that of a second class lever, with the fulcrum formed by axle 120 and the load applied between the axle and the top end of the plates, at which point the force with which the plates are moved is applied.

Figure 5:
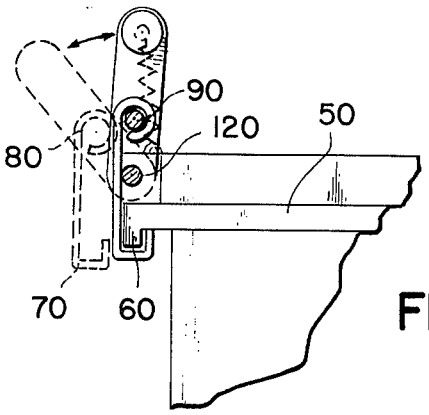
FIG. 5 is a view, taken along the lines V—V, of FIG. 4.

It can be seen that the hooks will engage the lips when the plates 100 are rotated to a vertical position. To keep the hooks so engaged, stud 130 is fixed in bar 110, and extends outwardly from one plate. A tension spring 140 is stretched between the stud and plate 10. It can be seen in FIG. 5 that this spring can hold the plates in an over-vertical position, tilted slightly inwardly towards the handle. This prevents the plates from being pulled away from an unstable vertical position, which would cause the hook to disengage from the lip.

An elongated rectangular wringer plate 150 has a center grill. The wringer plate 150 has the same general proportions as the bottom of the sponge and is pivotally secured at its ends between the arms of a Y-shaped member 160. The Y-shaped member 160 has a tail 161 (FIG. 1) pivotally secured to a lever 170, intermediate the ends of the member. The Y-shaped member 160 also has legs 162 and 163 pivotally affixed to opposite sides of the plate 150 via pivots 164 and 165, respectively. The lever 170 is elongated, and lies along the handle 20 of the device, being pivotally attached thereto by pivot 180 at the lower end of the lever.

Figure 2:
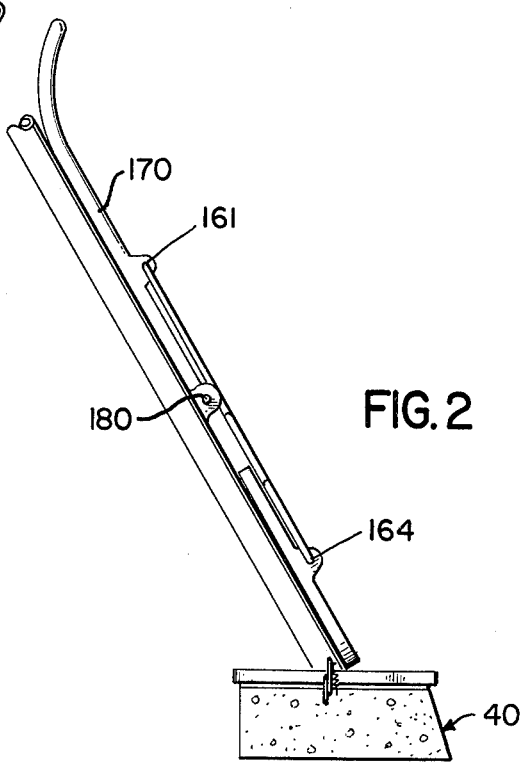
FIG. 2 is a side view of the mop of the invention.
Figure 4:
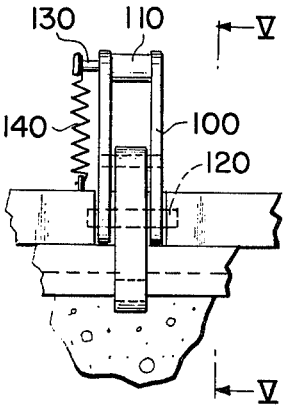
FIG. 4 is a side view of the locking device which detachably secures the sponge to the mop.
Figure 3:
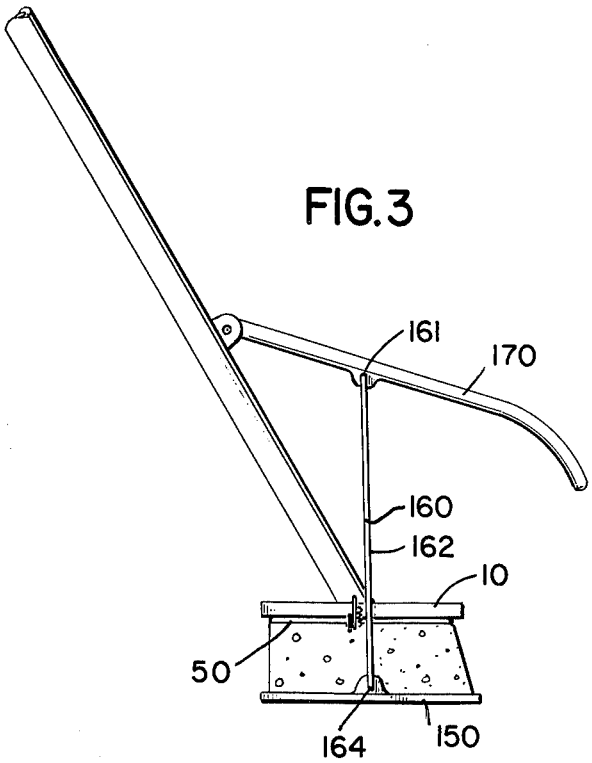
FIG. 3 is a side view of the mop of the invention with the wringing mechanism in use.

As is shown in FIG. 2, the grill, member and lever normally lie flat, parallel to and on top of the handle. However, when the sponge is to be squeezed free of water, the grill, lever and member are moved as shown in FIG. 3, with the grill underneath the sponge, the lever pivoted away from the handle, and the member extending vertically between the two. The handle can then be raised to pull the grill upwardly and to squeeze the water out of the sponge. As shown, the lever and member pivot in the vertical plane which includes the handle.

I claim:

1. A mop, comprising an elongated, upwardly and rearwardly extending handle;

a flat elongated horizontal rectangular first plate secured to the bottom of the handle;

a sponge;

locking means detachably securing the sponge to the bottom of the first plate, said locking means comprising a rectangular second plate affixed to the top of the sponge, the second plate being of substantially the same proportions as the first plate having ends and lips extending downwardly therefrom at said ends at right angles to the plane of the second plate, and a pair of lever actuated, pivoted hooks attached to a corresponding end of the first plate engaging the lips for detachably securing the second plate to the bottom of the first plate;

a pivot attached to the front of the handle above the first plate;

a lever attached at its lower end to the pivot and extending upwardly from the pivot along the handle, the lever being pivotable about the pivot in the plane defined by the handle and a vertical line;

an elongated rectangular wringer plate having a center grill; and a Y-shaped link member pivotally secured to the wringer plate and the lever in a manner whereby said wringer plate is pivotally secured between the ends of the legs of the Y and the tail of the Y is pivotally secured to the lever intermediate its ends.

2. The device of claim 1 wherein the sponge has rectangular faces and is trapezoidal in cross-section.

* * * * *